US006098376A

United States Patent [19]

Hailes et al.

[11] Patent Number: 6,098,376

[45] Date of Patent: Aug. 8, 2000

[54] LIGHT-TIGHT PACKAGE AND METHOD OF FORMING THE SAME

[75] Inventors: Rebecca Hailes, Kings Langley; Malcolm Hart, Hazelmere, both of United Kingdom

[73] Assignee: Eastman Kodak Company, Rochester, N.Y.

[21] Appl. No.: 09/384,456

[22] Filed: Aug. 27, 1999

[30] Foreign Application Priority Data

Aug. 28, 1998 [GB] United Kingdom ..... 9818723

[51] Int. Cl.[7] ..... B65B 11/00; B65B 11/12

[52] U.S. Cl. ..... 53/409; 206/415; 242/348.4

[58] Field of Search ..... 206/413, 415, 206/416, 410, 400, 398, 407, 414, 455; 53/409; 29/806

[56] References Cited

U.S. PATENT DOCUMENTS

| | | | |
|---|---|---|---|
| 3,568,397 | 3/1971 | Hammond | 53/409 |
| 4,148,395 | 4/1979 | Syracuse et al. | 206/414 |
| 4,455,076 | 6/1984 | Birkeland | 354/275 |
| 4,911,299 | 3/1990 | Peeters | 206/415 |
| 5,133,171 | 7/1992 | Chase et al. | 53/409 |
| 5,462,164 | 10/1995 | Cornelissen et al. | 206/389 |
| 5,515,970 | 5/1996 | Ritchie et al. | 206/397 |
| 5,655,659 | 8/1997 | Kennedy | 206/455 |
| 5,738,210 | 4/1998 | Kausch et al. | 206/416 |
| 5,941,387 | 12/1995 | Rasel | 206/413 |

FOREIGN PATENT DOCUMENTS

| | | | |
|---|---|---|---|
| 405294311 | 11/1993 | Japan | 53/409 |

*Primary Examiner*—Peter Vo
*Assistant Examiner*—Hemant M. Desai
*Attorney, Agent, or Firm*—Frank Pincelli

[57] ABSTRACT

A light-tight package for a roll 1 of light sensitive material has a central core 4 around which the material is wound, a flexible opaque leader 6 having a trailing end attached to the outermost end of the material and a pair of flexible end discs 7, 8 covering each end of the roll. Each end disc has a central hole 10 smaller than the inner diameter of the core, the inner diameter edge 9 of the disc being sealed to the inner wall of the core in the form of an unbroken seal.

4 Claims, 4 Drawing Sheets

LIGHT-TIGHT PACKAGE AND METHOD OF FORMING THE SAME

FIELD OF THE INVENTION

This invention relates to the field of packages for rolls of web material, in particular to rolls of light sensitive materials such as photographic paper and film.

BACKGROUND OF THE INVENTION

Rolls of light sensitive paper and film require light-tight packaging so that they are not exposed to daylight prior to use. However, the rolls should be packaged such that they can be loaded into co-operating apparatus under daylight conditions.

U.S. Pat. No. 4,148,395 discloses a package including a pair of flexible opaque end discs or covers attached to the ends of a core of the roll, and an opaque leader attached to a leading end of the length of material forming the roll. A peripheral portion on each end disc is folded over and adhered to an edge of an underlying convolution of the leader. A layer of adhesive is provided on the underside of the peripheral portion prior to folding over. As the leader is pulled away from the roll the end discs tear circumferentially at the edge of the roll, the peripheral portions remaining adhered to the leader.

U.S. Pat. No. 5,133,171 discloses a package which includes a pair of opaque flexible end discs attached to the ends of the core of the roll of material and an opaque leader attached to the leading end of the length of material forming the roll. After a first convolution of the leader is wrapped onto the roll peripheral portions of each end disc are folded over the first convolution. A second convolution is then wrapped onto the roll to capture the folded over portions between the first and second convolutions of the leader. No adhesive is used, friction being relied upon to hold the folded over portions between the convolutions.

U.S. Pat. No. 5,515,970 discloses a package having similar opaque end discs and leader. In this case the folded over portions of the end discs are held in place by adhesive tape strips. In both packages the end discs tear circumferentially at the edge of the roll when the leader is pulled.

Each disc has a central hole. The diameter of the central hole is smaller than the diameter of the core. The inner diameter edge of each disc is folded into the hollow core and secured to the inner wall using any suitable means. To facilitate attachment a plurality of radial cuts are made at the inner diameter edge of the disc. The cuts define a plurality of tabs which can be folded into the bore of the core along the inner wall. However, due to the inherent flexible and flimsy nature of the discs these cuts may tear and propagate to the end of the roll, thereby permitting the entry of light into the package.

The end discs of the light-tight package must be tearable when the leader is pulled. However it is also a requirement that the disc does not tear at the inner diameter portion which is adhered to the core. The invention therefore aims to provide a method of sealing the inner diameter portion of the disc to the inner wall of the core which reduces the possibility of the disc tearing at this point while still utilising a material which allows circumferential tearing.

SUMMARY OF THE INVENTION

The aim of the invention is to provide an improved light-tight package which remains properly closed until opened during room light loading.

According to the present invention there is provided a method of enclosing a roll of light sensitive web material in a package in a light-tight manner, the roll including a hollow cylindrical core having opposite ends and an inner wall, and a length of light sensitive material wound around the core, the method comprising the steps of; providing a flexible opaque leader having a leading and a trailing end, the trailing end being for attachment to the outermost end of the light sensitive material, providing a pair of flexible end discs adapted to cover each end of the roll of material, each end disc having a central circular opening with a diameter less than the inner diameter of the core, the outer diameter of each disc being greater than the diameter of the roll, placing each disc in substantially concentric relation to a respective one of the end surfaces of the roll, folding the outer diameter edge of each disc axially inwardly of a respective one of the end surfaces of the roll, and sealing the inner diameter edge of each disc to the inner wall of the core, the material of the disc stretching to form an unbroken inner seal.

The invention further provides a package for a roll of light sensitive web material, the roll including a hollow cylindrical core having opposite ends and an inner wall, and a length of light sensitive material wound around the core, the package comprising a flexible opaque leader having a leading end and a trailing end, the trailing end for attachment to the outermost end of the light sensitive material, a pair of flexible end discs adapted to cover each end of the roll of material, each end disc having a central circular opening with an unbroken edge and a diameter smaller than the inner diameter of the core, the outer diameter of each disc being greater than the diameter of the roll, the outer edges of each disc being folded axially inwardly of a respective one of the end surfaces of the roll and the inner diameter edge of each disc being sealed to the inner wall of the core in the form of an unbroken seal.

The method and package according to the invention provide important advantages over prior art packaging. The method allows the use of end discs or flanges which are much simpler to manufacture as no radial cuts need be made. As there are no radial cuts the positioning of the disc or flange when it is to be sealed to the core is not so critical. The discs can therefore be loaded on the sealing apparatus in the dark. This leads to greater productivity. The possibility of the discs tearing at the inner diameter is eliminated leading to improved reliability of the light-tightness of the package. The discs are also an improvement aesthetically.

The foregoing and other objects, features and advantages of the invention will be apparent from the following more particular description of the preferred embodiment of the invention illustrated in the accompanying drawings.

DETAILED DESCRIPTION OF THE INVENTION

As certain features of, and methods of manufacturing, light sensitive web roll packages are well known the following description is directed in particular to those methods and features relating directly to the invention. Features not specifically shown or described herein can be any of those known in the prior art.

Figure 1:
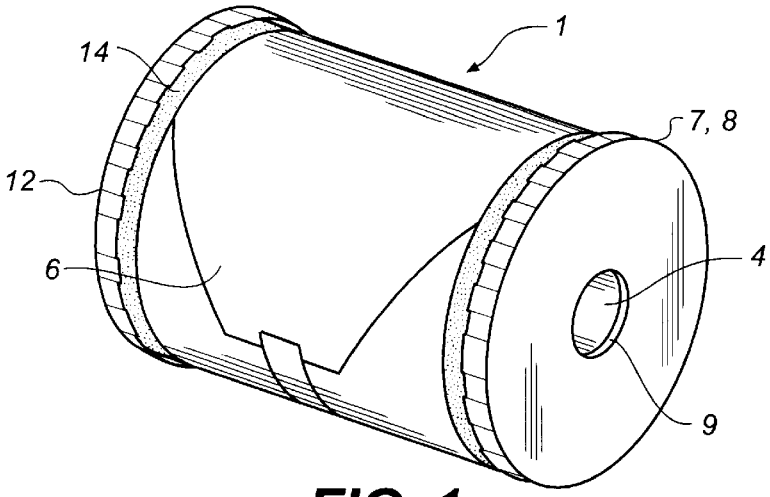
FIG. 1 is a perspective view of a package assembled according to the present invention.
Figure 2A:
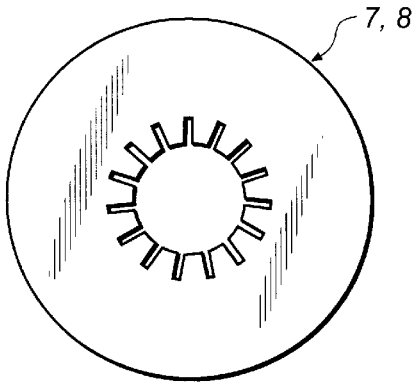
FIGS. 2A and 2B show schematics of a prior art flange before sealing and a new flange before sealing.
Figure 2B:
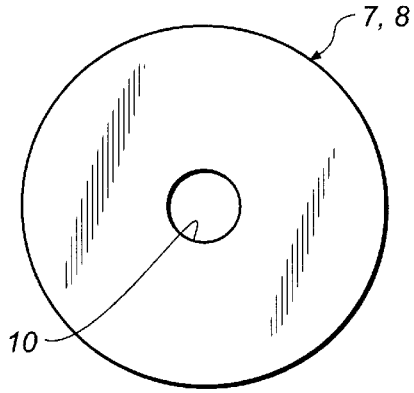

FIG. 1 shows a roll 1 of light sensitive web material, such as photographic paper or film. The roll 1 includes a central hollow core 4, typically made of cardboard, having opposite ends and a length approximately equal to the width of the web. A length of web is wound onto the core 4 such that the wound roll 1 has opposite end faces. A leading end of the web is attached to a flexible, opaque leader 6. The leader includes a trailing end and a width approximately equal to the width of the web material. The length of the leader is at least equal to one circumference of the roll 1 to prevent exposure of the web to light. The leader may be made of any suitable opaque material, such as a polyester/polythene laminate. A suitable supplier is Brand Packaging Limited of Pendleton, England. Adhesion means, such as strip tape, may be used to attach the leader to the web.

A pair of end discs, or flanges, 7, 8 are provided to cover the end surfaces of the roll 1. The outer diameter of each end disc 7, 8 is slightly larger than the diameter of the wound roll of web material to provide rims or peripheral portions 12. The peripheral portions will be in the region of 10 mm. In the assembled package the peripheral portions 12 of the discs are folded over the circumferential edges of the leader 6 and adhered thereto. The folded over portions of the discs 7, 8 may be held in place by strips of adhesive tape 14. As the leader 6 unwinds from the roll it begins to tear the peripheral portions 12 from the end discs 7, 8. When the leader is completely unwound the peripheral portions will have been torn from the end discs 7, 8.

Each disc 7, 8 is provided with a central hole 10. The diameter of the central hole is smaller in diameter than the internal diameter of the core 4. The difference in the diameter of the central hole and the internal diameter of the core is in the region of 8 mm. The inner diameter portion 9 of the discs are unbroken, i.e. no radial slits or such like extend from the central hole 10. The discs are made of an opaque, thin, flexible, laminate material. The material is capable of stretching to such an extent that it allows the discs to be folded into the core 4 along the inner wall thereof to form a light-tight seal without the use of the radial slits. Any material having the requisite ability to tear but also to stretch as required can be used, possible materials including various laminates of polyester and aluminium foil. Suitable laminates would be:

12 micron polyester film/1 micron black ink/2.5 micron adhesive/25 micron aluminium foil/1 micron black ink/2.5 micron adhesive/12 micron polyester film/approximately 30 micron 812 adhesive 25 G.S.M.±5 G.S.M.

12 micron polyester film/adhesive/12 micron polyester film/black ink/primer/12 micron LDPE/9 micron foil/25 micron DOW LDPE with coating weight of 45 G.S.M.±5 G.S.M.

The second example is preferable due to the absence of adhesive on the outer layer.

Both the above materials are supplied by B.D.K. Industrial Products Ltd, Suffolk, England.

To assemble the package according to the invention the web is wound on the core 4. After winding the end discs 7, 8 are attached to the core at the central portion.

The end discs 7, 8 are sealed to the core by using a thermally heated apparatus. The apparatus includes a thermally conductive support body with an edge surface, heating means, an expandable element, means for holding the element in place and means for pressurising the element into contact with the disc to thermally attach the disc to the inner wall of the core.

Figure 4A:
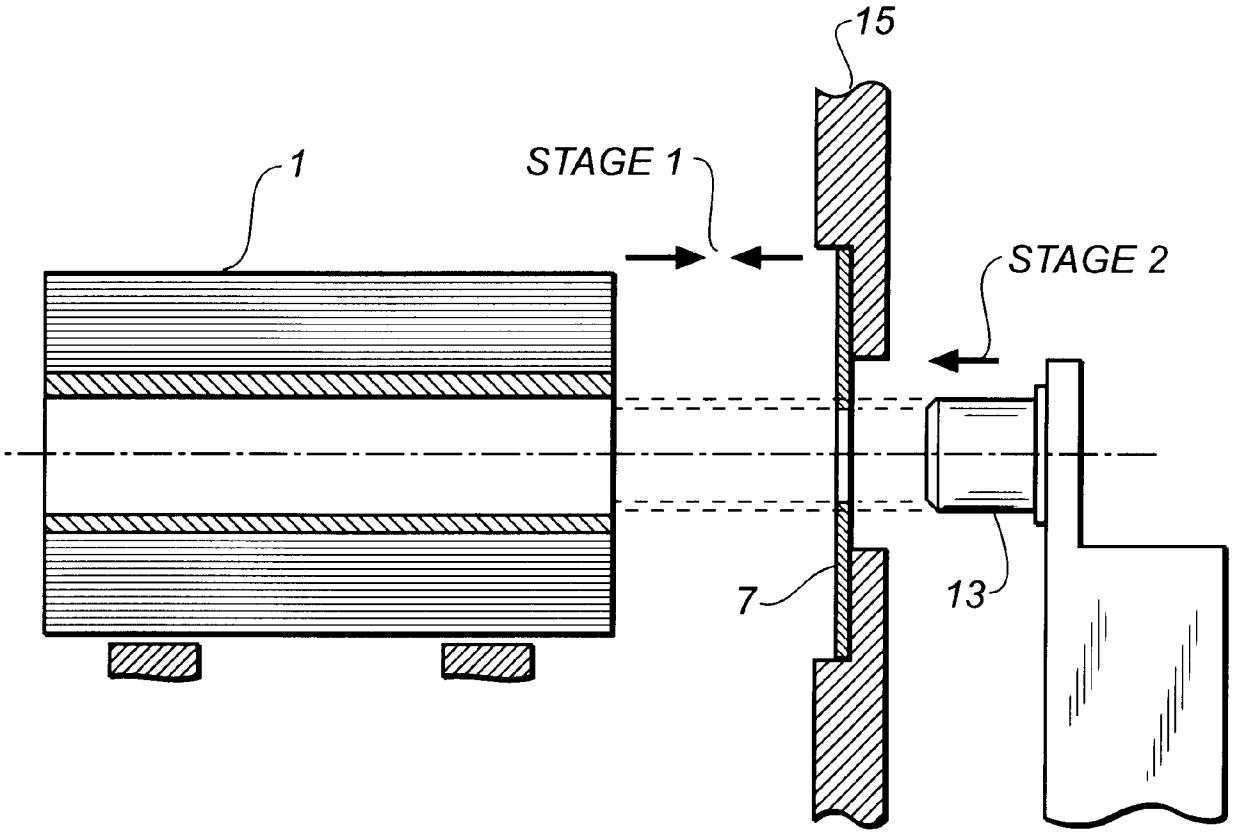
FIGS. 4*a*, 4*b* and 4*c* show how the flange is sealed to the inner wall of the core.
Figure 4B:
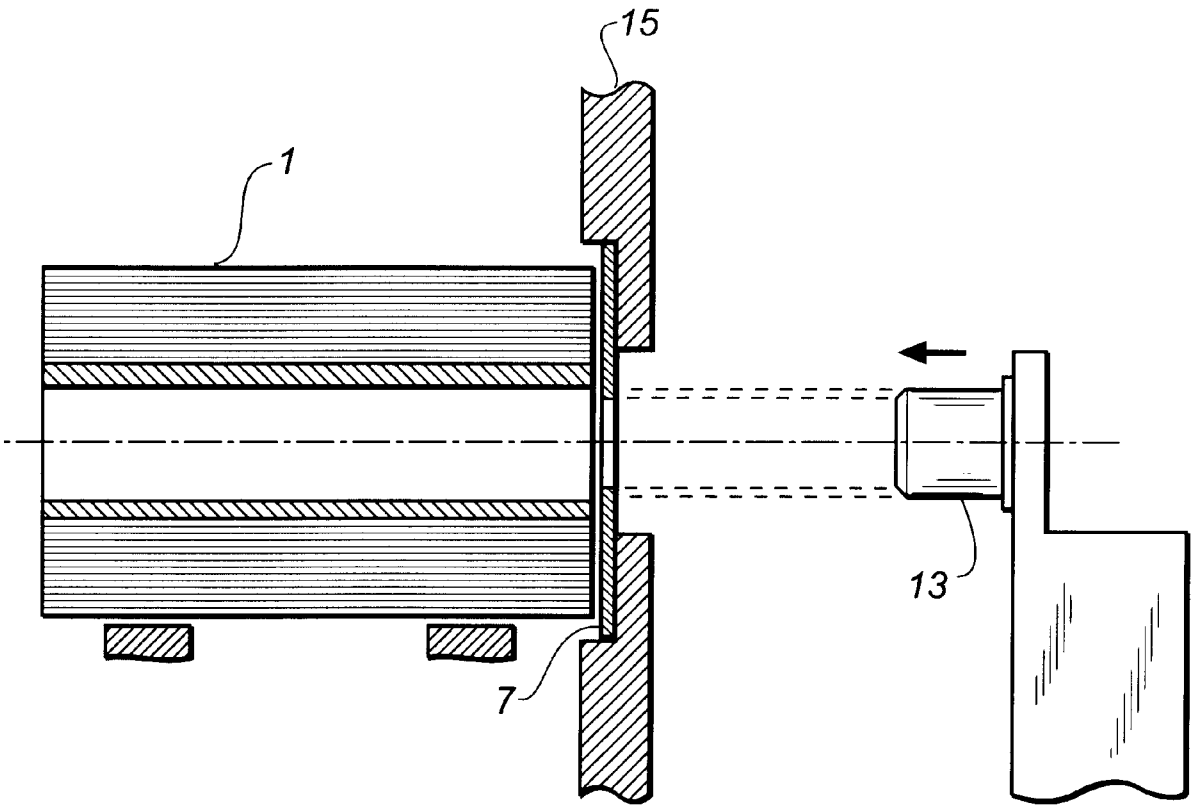
Figure 4C:
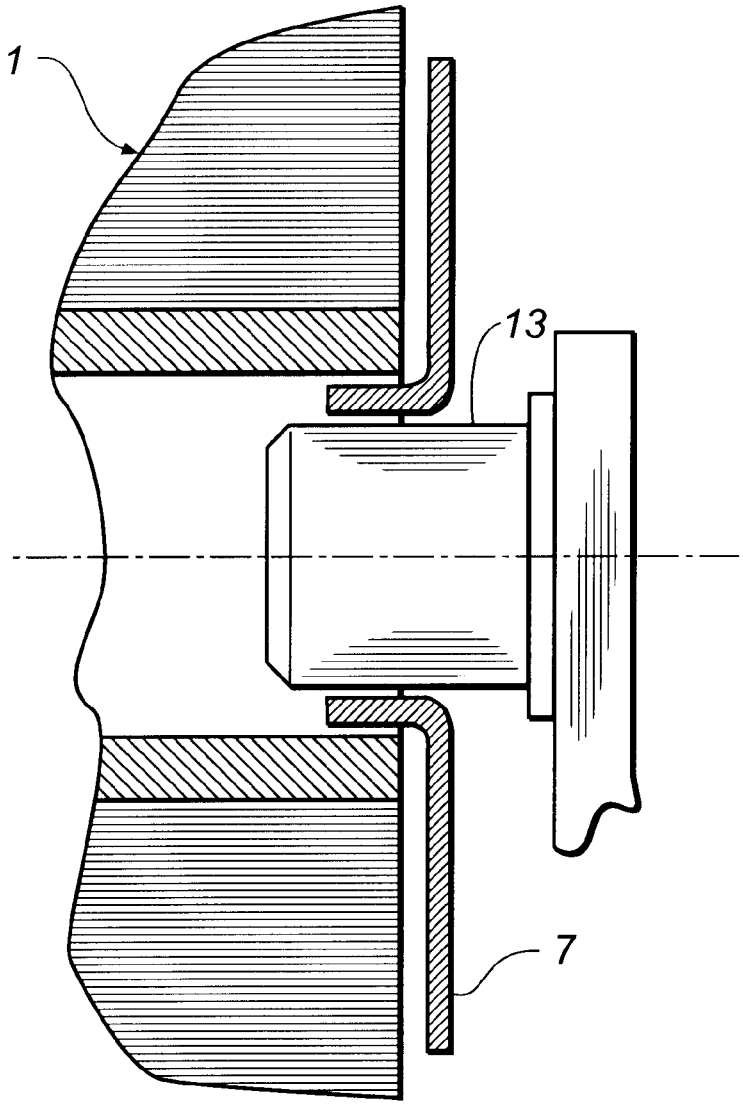

FIGS. 4*a*, 4*b* and 4*c* show the sealing process in more detail.

The roll 1 is positioned on the apparatus. An end disc is held by a picker head 15 by conventional means. The central hole of the end disc is aligned approximately with the center of the core. As there are no radial slits or the like which must fall within the inner diameter of the core the disc is more easily located accurately on the apparatus. The roll and picker head move towards each other as shown by the arrows in FIG. 4*a*. Once the roll and picker head are in contact with each other the heater 13 moves towards and enters the roll core. The heater is heated to a temperature suitable for thermally attaching the end disc to the inner wall of the core. It can be seen from FIGS. 4*a* and 4*b* that the unexpanded diameter of the heater is greater than the inner diameter of the end disc. Therefore, as the heater enters the core it pushes through the end disc, stretching the disc into the core and folding it axially inwardly thereof. The heater remains in the core for approximately 1.5 seconds during which time it expands and compresses the disc against the inner wall of the core, sealing it thereto. The heater is then withdrawn from the core. FIG. 4*c* shows an enlarged detail of the roll showing how the disc is sealed to the core.

Figure 3:
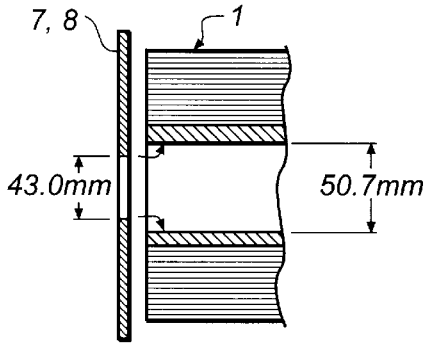
FIG. 3 is a diagram showing how the inner diameter of the flange increases.

FIG. 3 illustrates how the inner diameter of the disc increases to fit the inner wall of the core. The stress put upon the disc whilst it is being formed into the centre of the core is diffused by the elongation (strain) of the disc material in a direction which is tangential to the inner diameter of the disc.

As stated earlier the invention provides numerous benefits. The disc or flange is simpler to manufacture as it only requires a central hole to be formed. The disc can therefore be made faster than if radial slits are required at the inner diameter 9. Loading of the discs in the apparatus sealing the discs to the core is simplified and improved and can be performed in the dark. No new hardware is required. The apparatus does not need to be modified to perform the method according to the invention. These benefits allow faster, more efficient production of the packages.

The invention has been described with particular reference to a preferred embodiment. It will be understood by those skilled in the art that variations and modifications can be made within the scope of the claims.

What is claimed is:

1. A method of enclosing a roll of light sensitive web material in a package in a light-tight manner, the roll including a hollow cylindrical core having opposite ends and an inner wall, and a length of light sensitive material wound around the core, the method comprising the steps of; providing a flexible opaque leader having a leading and a trailing end, the trailing end being for attachment to an outermost end of the light sensitive material, providing a pair of one piece flexible end discs adapted to cover each end of the roll of material, each end disc having a central circular opening with a diameter less than the inner diameter of the core, the outer diameter of each disc being greater than the diameter of the roll, placing each disc in substantially concentric relation to a respective one of an end surface formed at each end of the roll, folding the outer diameter edge of each disc axially inwardly of a respective one of the end surfaces of the roll, and heat sealing the inner diameter edge of each disc to the inner wall of the core, the material of the disc stretching to form an unbroken inner seal.

2. A package for a roll of light sensitive web material, the roll including a hollow cylindrical core having opposite ends and an inner wall, and a length of light sensitive material wound around the core, the package comprising a flexible opaque leader having a leading end and a trailing end, the trailing end for attachment to an outermost end of the light sensitive material, a pair of one piece flexible end discs adapted to cover each end of the roll of material, each end disc having a central circular opening with an unbroken edge and a diameter smaller than the inner diameter of the core, the outer diameter of each disc being greater than the diameter of the roll, the outer edges of each disc being folded axially inwardly of a respective one of an end surface formed at each end of the roll and the inner diameter edge of each disc being heat sealed to the inner wall of the core in the form of an unbroken seal.

3. A package according to claim 2 wherein the end discs are made from a material having sufficient tensile strength to resist tearing when stretched to form the seal.

4. A package according to claim 2 wherein the end discs are made from a laminate of polyester, aluminium and sealing media.

* * * * *